US005557383A

United States Patent [19]

Hasegawa et al.

[11] Patent Number: 5,557,383

[45] Date of Patent: Sep. 17, 1996

[54] IMAGE FORMING APPARATUS HAVING RECORDING MATERIAL CARRYING MEANS

[75] Inventors: Takashi Hasegawa, Matsudo; Masahiro Inoue, Kawasaki; Nobuhiko Takekoshi, Yokohama, all of Japan

[73] Assignee: Canon Kabushiki Kaisha, Tokyo, Japan

[21] Appl. No.: 549,021

[22] Filed: Oct. 27, 1995

Related U.S. Application Data

[63] Continuation of Ser. No. 458,446, Jun. 2, 1995, abandoned, which is a continuation of Ser. No. 123,203, Sep. 20, 1993, abandoned, which is a continuation of Ser. No. 772,956, Oct. 8, 1991, abandoned.

[30] Foreign Application Priority Data

Oct. 9, 1990 [JP] Japan ..... 2-271637
Oct. 12, 1990 [JP] Japan ..... 2-272147

[51] Int. Cl.[6] ..... G03G 15/14

[52] U.S. Cl. ..... 355/271; 355/326 R

[58] Field of Search ..... 355/200, 210, 355/212, 211, 271, 274, 275, 281, 326 R, 327, 317, 311, 308, 309

[56] References Cited

U.S. PATENT DOCUMENTS

| | | | |
|---|---|---|---|
| 3,924,848 | 12/1975 | Murakami | 271/10.1 |
| 3,976,375 | 8/1976 | Kurita et al. | 355/212 X |
| 4,416,534 | 11/1983 | Kluger | 355/317 |
| 4,531,828 | 7/1985 | Hoshino | 355/317 |
| 4,662,739 | 5/1987 | Sakai et al. | 355/200 X |
| 4,860,054 | 8/1989 | Higuchi . | |
| 4,912,515 | 3/1990 | Amemiya et al. | 355/274 |
| 4,914,737 | 4/1990 | Amemiya et al. | 355/274 |
| 5,019,871 | 5/1991 | Takeda et al. | 355/309 |
| 5,130,724 | 7/1992 | Crowley | 355/317 X |
| 5,158,846 | 10/1992 | Bujese | 355/327 X |
| 5,287,160 | 2/1994 | Dastin et al. | 355/275 X |
| 5,300,982 | 4/1994 | Inamoto et al. | 355/275 X |
| 5,414,501 | 5/1995 | Miura et al. | 355/271 |

FOREIGN PATENT DOCUMENTS

| | | |
|---|---|---|
| 0311359 | 4/1989 | European Pat. Off. . |
| 54-086344 | 7/1979 | Japan . |
| 57-63569 | 4/1982 | Japan . |
| WO8805564 | 7/1988 | WIPO . |

*Primary Examiner*—Arthur T. Grimley
*Assistant Examiner*—Shuk Yin Lee
*Attorney, Agent, or Firm*—Fitzpatrick, Cella, Harper & Scinto

[57] ABSTRACT

An image forming apparatus includes a recording material carrying member for carrying a recording material, the recording material carrying member having a seam and being movable along an endless path; an image forming device for forming an image on the recording material carried on the recording material carrying member; wherein a length $l$ of the recording material measured in a direction of movement of the carrying member, a distance a between a trailing edge of the recording material and a leading edge of the next recording material when the recording materials are continuously supplied to the recording material carrying member, and a circumferential length L of the recording material carrying member substantially satisfy:

$$L=n(l+a)$$

(n: integer).

8 Claims, 11 Drawing Sheets

IMAGE FORMING APPARATUS HAVING RECORDING MATERIAL CARRYING MEANS

This application is a continuation of application Ser. No. 08/458,446, filed Jun. 2, 1995, now abandoned, which is a continuation of application Ser. No. 08/123,203, filed Sep. 20, 1993, now abandoned, which is a continuation of application Ser. No. 07/772,956, filed Oct. 8, 1991, now abandoned.

FIELD OF THE INVENTION AND RELATED ART

The present invention relates to an image forming apparatus for forming an image on a recording material carried on a recording material carrying means, and more particularly to an image forming apparatus for forming a multicolor image on the recording material.

A color copying machine or the like having plural image forming stations is known wherein different color images are formed by the respective image forming stations, and the images are superposedly transferred onto the recording material in the form of a transfer sheet.

Referring first to FIG. 5, an example of such an image forming apparatus will be described, wherein PA, PB, PC and PD are black, yellow, magenta and cyan image forming stations. Below the respective image forming stations PA, PB, PC and PD, a recording material carrying means in the form of a transfer material conveying belt 200 is disposed which carries the transfer sheet P and which is movable along an endless path. Each of the image forming stations PA, PB, PC or PD has an image bearing member 100*a*, 100*b*, 100*c* or 100*d*, around which there are disposed a latent image forming station 101*a*, 101*b*, 101*c* and 101*d*, a developing station 102*a*, 102*b*, 102*c* or 102*d*, an image transfer station 103*a*, 103*b*, 103*c* or 103*d*, a cleaning station 104*a*, 104*b*, 104*c* or 104*d*. The developing stations 102*a*, 102*b*, 102*c* and 102*d* contain different color developers. The transfer stations 103*a*, 103*b*, 103*c* and 103*d* comprise image transfer means disposed within the transfer belt path.

The transfer sheet P is fed out of a sheet cassette 110 and is adhered to the transfer belt 200. It is passed through the image forming stations PA, PB, PC and PD so that the color images formed on the photosensitive drums 100*a*, 100*b*, 100*c* and 100*d* are sequentially transferred onto the transfer sheet P by the transfer stations 103*a*, 103*b*, 103*c* and 103*d*, by which a full (four) color image is formed on the transfer sheet P.

The transfer material conveying belt 200 comprises a film sheet of polyethylene terephthalate resin, polyvinylidene fluoride resin or another dielectric resin material, having opposite ends which are overlaid and bonded into an endless film sheet. Therefore, it comprises a seam 200*a*. The seam portion 200*a* has different characteristics from the other portion, and therefore, if an image is transferred onto the transfer sheet P through the seam 200*a*, the transfer action is not satisfactory with the result of defective images. In view of this, when the transfer sheet P is supported on the transfer material conveying belt 200, the transfer sheet P is supplied to the transfer belt 200 so that it is not supported on the seam 200*a*.

However, when the apparatus is operated in a continuous mode wherein images are continuously transferred onto plural transfer sheets P in response to one image formation signal, and therefore, the transfer sheets P are continuously supplied to the transfer belt 200, a problem arises depending on the circumferential length of the transfer belt 200.

It is assumed for example that the total circumferential length of the transfer belt 200 is 800 mm, that the maximum usable sheet is A3 (420×297 mm) and that the A3 sheet is supplied with 420 mm in the belt 200 moving direction. As shown in FIG. 6A, in order to avoid the seam 200*a*, the transfer sheet P1 is supplied to the position 40 mm away from the seam 200*a*, for example. If the next transfer sheet P2 is supplied to the position 70 mm away from the trailing edge of the first transfer sheet P1, the transfer sheet P2 is partly on the seam 200*a*.

Therefore, it is required that the next transfer sheet P2 is supplied to the transfer belt 200 at the position 40 mm away from the seam 200*a*. Thus, the efficiency of use of the transfer belt 200 is:

$$K=420/800\times100=52.5\ \%$$

This is small with the result of significant reduction of the number of copies per unit time in the continuous image formation mode.

The inconvenience is not as large with sheet 5 other than the maximum size sheet for example, a transfer sheet of A4 size (210 mm in the belt moving direction) is supplied to the transfer belt 200 having a circumferential length of 800 mm. As shown in FIG. 6C, three transfer sheets P1, P2 and P3 are supplied to the belt 200. Even in this case, none of the transfer sheets is on the seam 200*a* of the belt 200, and the sufficient sheet intervals (approximately 56 mm in this case) can be assured.

The efficiency of use K (the percentage of the transfer material carrying length in the entire circumferential length of the belt) is:

$$K=(210\times3)800\times100=78{,}725\%$$

Therefore, the above-described in conveyances do not arise.

SUMMARY OF THE INVENTION

Accordingly, it is a principal object of the present invention to provide an image forming apparatus having an improved efficiency of use of the recording material carrying means.

It is another object of the present invention to provide an image forming apparatus wherein the number of prints or copies per unit time is increased.

It is a further object of the present invention to provide an image forming apparatus capable of forming good transferred images.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1A:
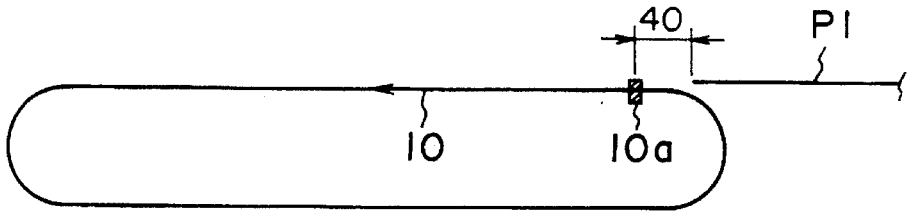
FIG. 1A and 1B show a supply of a transfer sheet to a transfer material conveying belt in an image forming apparatus according to an embodiment of the present invention.
Figure 1B:
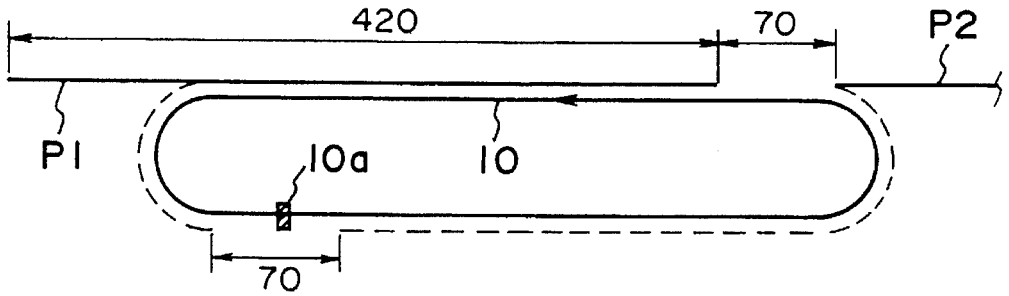
Figure 2A:
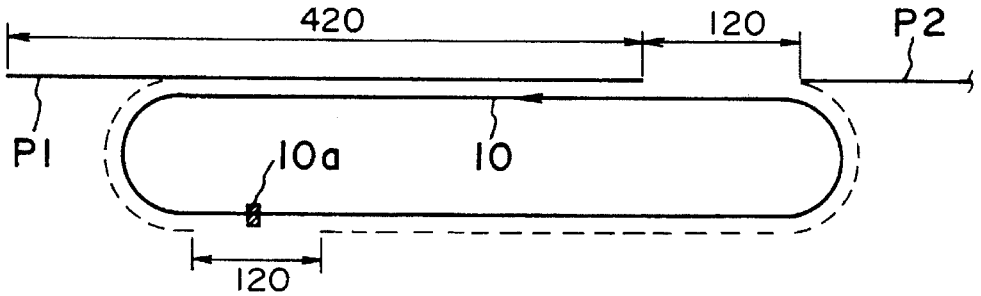
FIG. 2A and 2B show the same in a modified image forming apparatus according to an embodiment of the present invention.
Figure 2B:
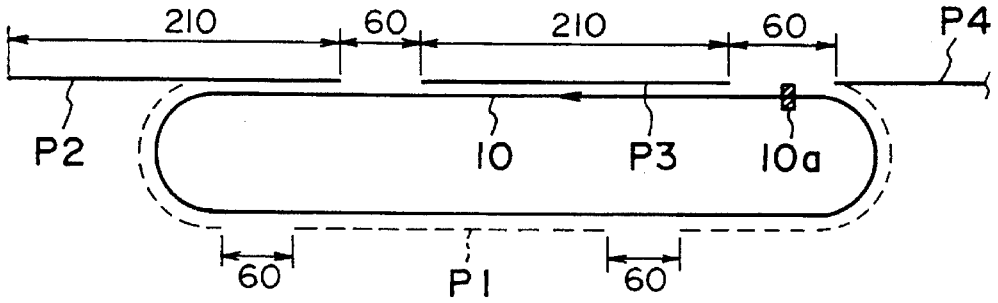
Figure 3:
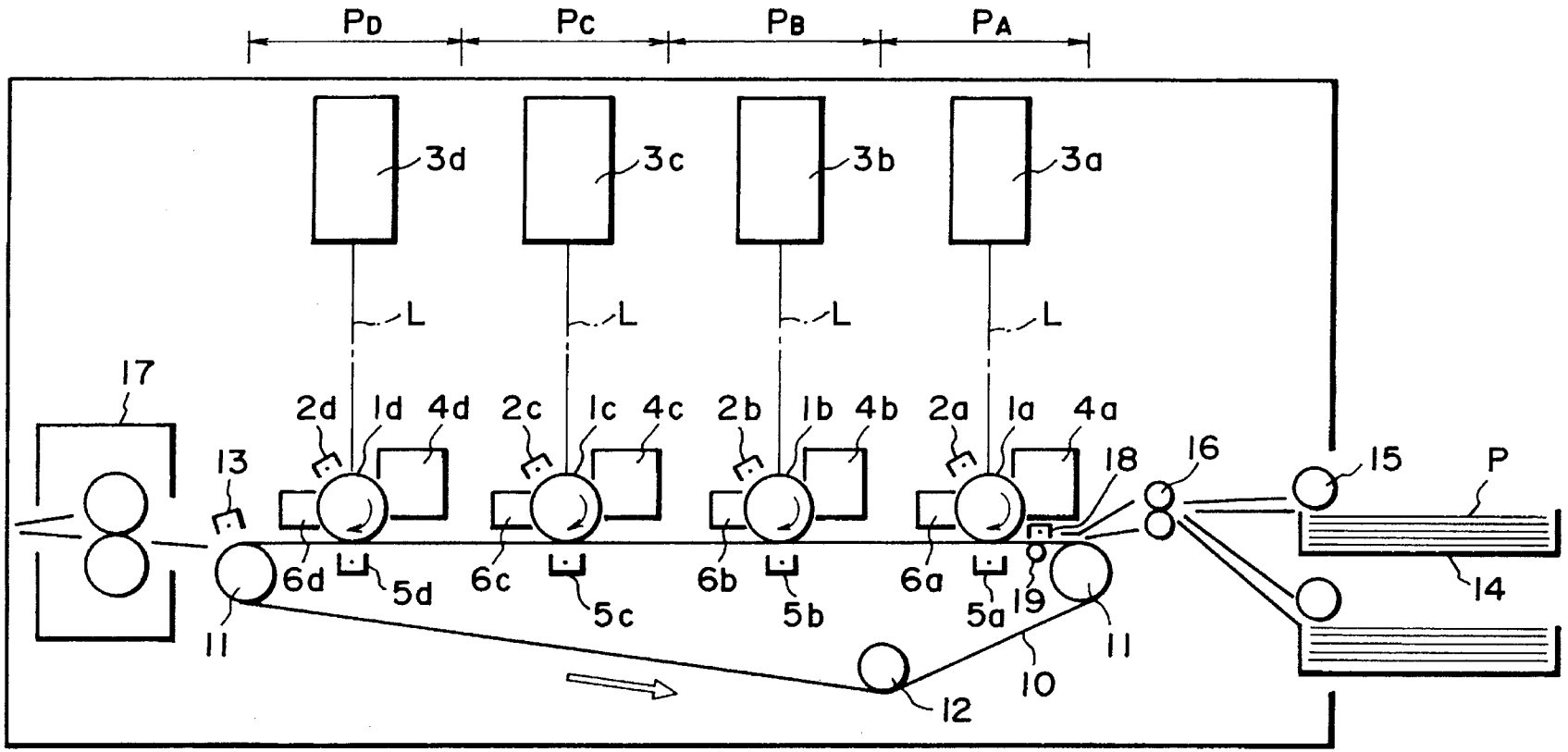
FIG. 3 is a sectional view of the image forming apparatus.

Referring to FIGS. 1, 2 and 3, the description will be made as to a first embodiment.

In FIG. 3, there is shown an image forming apparatus according to this embodiment, wherein PA, PB, PC and PD designate black, yellow, magenta and cyan image forming stations, which are arranged on a horizontal line. Below the image forming stations PA, PB, PC and PD, there is disposed a transfer material conveying belt 10 (transfer material carrying means) movable along an endless path.

The image forming stations PA, PB, PC and PD have photosensitive drums 1*a*, 1*b*, 1*c* and 1*d*, respectively. Around each of the photosensitive drums 1*a*, 1*b*, 1*c* and 1*d*, there are disposed a charger 2*a*, 2*b*, 2*c* or 2*d*, a scanner unit 3*a*, 3*b*, 3*c* or 3*d*, a developing device 4*a*, 4*b*, 4*c* or 4*d*, an image transfer charger 5*a*, 5*b*, 5*c* or 5*d*, and a cleaning device 6*a*, 6*b*, 6*c* or 6*d*. The transfer charger 5*a*, 5*b*, 5*c* or 5*d*, is disposed in the transfer material conveying belt 10 travel. The transfer charger 5a, 5*b*, 5*c* or 5*d*is effective to transfer the toner image from the photosensitive drum 1*a*, 1*b*, 1*c* or 1*d* onto the transfer sheet P.

The transfer material conveying belt 10 is made of polyurethane resin, PVdF resin, PET resin, polycarbonate resin, polyether sulfone resin, polyurethane resin or another dielectric resin material. The transfer belt 10 is in the form of a film having opposite ends which are bonded by ultrasonic wave fusing means or the like into an endless film. It is rotated at a constant speed (100 mm/sec, for example) in the direction indicated by an arrow in FIG. 3 by driving rollers 11 and 11. Designated by a reference numeral 12 is a tension roller.

The transfer belt 10 electrostatically attracts the transfer sheet P and carries it through the image forming stations PA, PB, PC and PD, so that the transfer sheet P receives images in the respective image forming stations. After receiving the images, the transfer sheet P is subjected to the discharging operation, and is separated from the transfer belt 10 by a separation charger 13 disposed at a sheet discharge side of the transfer belt 10.

At the sheet supply side of the transfer belt 10, there is a cassette 14, a pick-up roller 15, and registration rollers 16. At the sheet discharge side of the transfer belt 10, there is an image fixing device 17 and others.

The image forming operation of the image forming apparatus will be described, taking the black color image forming station PA as an example. The photosensitive drum la is uniformly charged by a charger 2*a* and is exposed to image light L for the black image through a scanner unit 3*a*, so that an electrostatic latent image is formed on the photosensitive drum 1*a*. The electrostatic latent image is moved to the developing device 4*a* having the black toner by the rotation of the photosensitive drum 1*a*. The developing device 4*a* visualizes the latent image into a black toner image. The toner image is transferred onto the transfer sheet P on the transfer belt 10 by a transfer charger 5*a* at an image formation position, that is, the transfer position where the photosensitive drum la and the transfer charger 5*a* are faced to each other through the belt 10. After the image transfer, the photosensitive drum 1*a* is cleaned by a cleaning device 5*a* so that the residual toner is removed therefrom, and the photosensitive drum 1*a* is prepared for the next image forming operation.

In the yellow image forming station PA, the photosensitive member is uniformly charged and is exposed to yellow image light L in the similar manner but at a timed relation with the image forming operation in the former image forming station PA. The latent image is developed into a yellow toner image by the developing device 4*b* containing the yellow toner. The yellow toner image is superposedly transferred onto the transfer sheet P already having the black toner and conveyed by the belt 10, at an image formation station, that is, an image transfer position where the photosensitive drum 1*b* and the transfer charger 5*b* are faced to each other.

In the similar manner, the magenta and cyan images are formed in the image forming station PC and PD, so that magenta and cyan toner images are formed and transferred onto the transfer sheet P. As a result, four full-color toner image is formed on the transfer sheet P.

The transfer sheet P is singled out by the pick-up roller 15 from the sheet cassette 14, and is supplied to the registration rollers 16, which further feed the sheet to the transfer material in synchronism with the drum. The transfer sheet P is attracted on the transfer belt 10 by the attraction charger 18 and the attraction roller 19, and is carried through the four image forming stations PA, PB, PC and PD, so that four color toner images are superposedly transferred onto the transfer sheet P. After receiving the images, the transfer sheet P is subjected to the operation of the separation charger 13 adjacent a discharge side end of the belt 10, and therefore, is separated from the transfer belt 10. Then, it is conveyed to the fixing device 13 where the toner image thereon is fixed into a permanent image.

As shown in FIG. 1, the transfer belt 10 has a seam 10*a*. If the transfer sheet P is on the seam 10*a*, the toner image is not properly transferred onto the transfer sheet P at the position on the seam 10*a*. In view of this, when the transfer sheet P is supplied to the transfer belt 10, it is avoided that the transfer sheet P is on the seam 10*a*.

If the length of the circumference of the transfer belt 10 is arbitrarily determined, the transfer sheet P is unable to be supplied to the transfer belt 10 with a predetermined sheet interval (the interval from the trailing edge of the transfer sheet to the leading edge of the next transfer sheet on the belt 10) in a continuous copying or printing mode, when a maximum size transfer sheet P is used.

In this embodiment, the circumferential length L of the transfer material conveying belt 10 substantially satisfies:

$$L=n(l+a)$$

where l is the length of the maximum usable transfer sheet P, a is the clearance between the successive transfer sheets P, and n is an integer. By doing so, the above-described inconveniences can be avoided. In order to avoid the possibility of the sheet jamming or the like, the interval a is preferably not less than 50 mm.

If, for example, l=420 mm, a=70 mm, n=2, and L=980 mm (maximum usable transfer sheet P: A3), the transfer sheet P1 is supplied to the transfer material conveying belt 10 to the position 40 mm away from the seam 10*a* so as to avoid the seam 10*a*, as shown in FIG. 1A. Then, as shown in FIG. 1B, the next transfer sheet P2 is supplied with an interval of 70 mm from the trailing edge of the first transfer sheet P1. Then, the second transfer sheet P2 is not on the seam 10*a* of the belt 10.

Accordingly, the efficiency K of use of the transfer belt 10 is:

$$K=420\times2/980\times100\text{m-}85.7\%$$

Thus, the transfer material conveying belt 10 is efficiently used. In addition, the number of image formations on the transfer sheets P per unit time is increased in the continuous operation mode.

Because of the improvement of the use efficiency K of the transfer belt 10, the image formation speed in the image forming stations PA, PB, PC and PD can be reduced, including the rotational speed of the transfer belt 10, and therefore, the size and cost of the apparatus can be reduced. The transfer belt 10 is usable not only with the A3 size sheets but also with ledger size (17×11 inch) relatively frequency used in U.S.A., if the sheet interval a is 58.2 mm in the continuous mode with sufficiently high use efficiency K of the transfer belt.

When an image is formed on the transfer sheet P having an A4 size (l=210 mm), using the above-described transfer belt 10, with the sheet interval a of 116 mm and n equal to 3, use efficiency K of the belt 10 is:

$$K=210\times3/980\times100\text{ m-}64\%,$$

therefore, the efficiency slightly lowers.

If the circumferential length of the transfer belt 10 is 1080mm; l=420 mm; a=120mm; and n=2, as shown in FIG. 2A, then the use efficiency K for A4 size is:

$$K=420\times2/1080\times100=77.8\ \%$$

This is still slightly lower but when the images are continuously formed on the transfer sheet P having the size of A4 (l=210 mm) using this transfer belt 10, the sheet interval is one half the interval in the case of A3 size as shown in FIG. 2A, a=60 mm, then n=4, and the use efficiency K is:

$$K=210\times4/1080\times100\text{m-}77.8\%$$

Thus, the efficiency is improved.

Thus, when the images are formed in the continuous mode using a transfer material carrying belt 10, on a transfer sheet P having a size which is one half the maximum usable size, the sheet interval a is set to approximately 50 mm (minimum limit), and the sheet interval is approximately one half the sheet interval for the maximum size of the transfer sheet, by properly determining the total length L of the transfer belt 10. By doing so, even in the case of the continuous mode for the maximum usable size transfer sheet P, the efficiency K of use of the transfer material carrying belt 10 can be maintained at a substantially high level.

Figure 4:
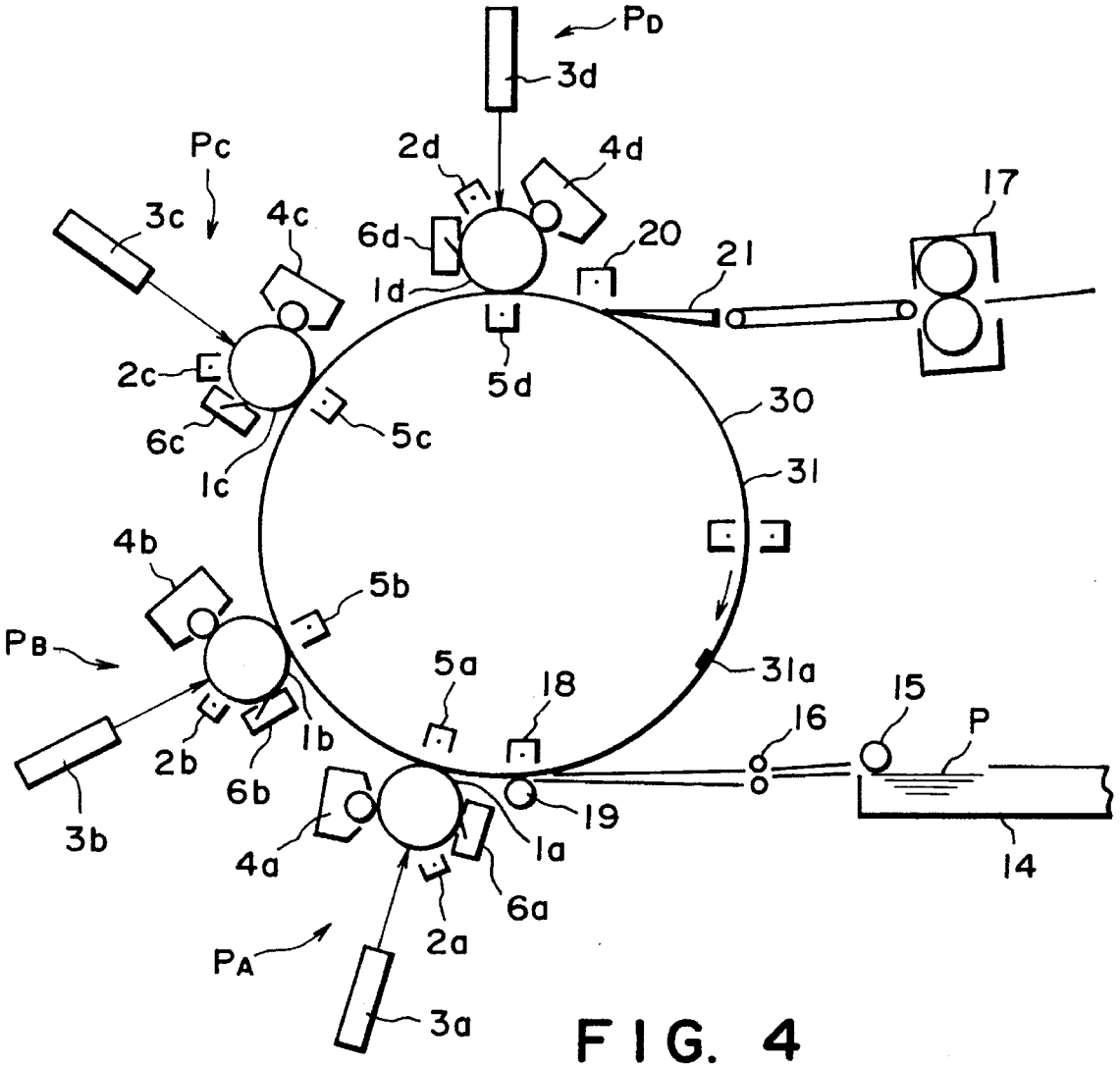
FIG. 4 is a sectional view of a major part of an image forming apparatus according to a second embodiment of the present invention.
Figure 5:
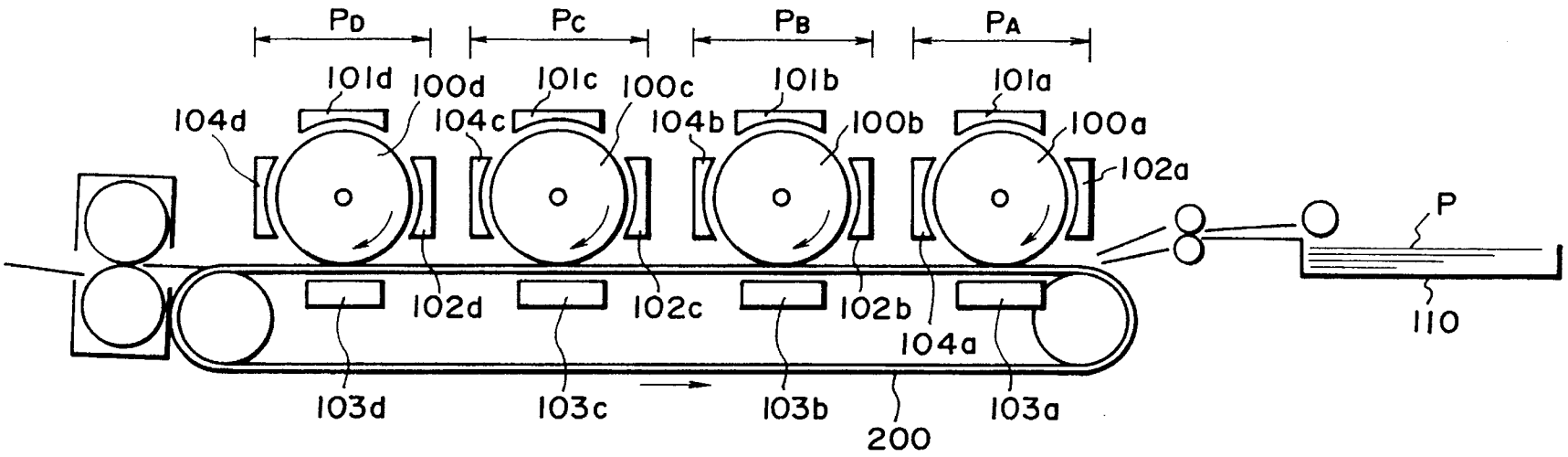
FIG. 5 is a sectional view of a conventional image forming apparatus.

Referring to FIG. 4, the description will be made as to the second embodiment. The same reference numerals as in the first embodiment are assigned to the elements having the corresponding functions. In this embodiment, a transfer drum replaces the transfer material carrying belt in the first embodiment. In FIG. 4, outside the transfer drum 30, there are disposed black, yellow, magenta and cyan image forming stations PA, PB, PC and PD to constitute a multi-color image forming apparatus. At the sheet feeding side of the transfer drum 30, there are disposed a sheet supply cassette 14, a sheet pick-up roller 15, registration rollers 16, an attraction charger 18 and an attraction assisting roller 19. At the sheet discharge side of the transfer drum 30, there are disposed a separation charger 20, a separating pawl 21 and an image fixing device 17.

The transfer sheet P is supplied to the transfer drum 30 by the sheet cassette 14, the pick-up roller 15 and the registration roller 16 and is charged by an attraction charger 18 and is attracted and supported on the outer surface of the transfer drum 30 by the grounded attraction assisting roller 19. Through the rotation of the transfer drum 30, the black, yellow, magenta and cyan toner images are superposedly transferred onto the transfer sheet P by image forming stations PA, PB, PC and PD. After the image transfer, the transfer sheet P is discharged by the separation charger 20, and is separated from the transfer drum 30 by a separation pawl 21. It is then fed to the fixing device 17 where the superposed toner images are heated and fixed on the transfer sheet P so that they are fused and mixed into a full color image.

The outer surface of the transfer drum 30 is provided by a film sheet 31 (transfer material carrying member) made of the same material as the transfer belt 10 of the first embodiment. The sheet 31 is in the form of an endless sheet with a seam 31*a* and mounted on opposing rings made of metal or the like. The transfer sheet P is attracted and supported on the film sheet 31. It is therefore desirable that the transfer sheet P is supplied to the transfer drum 30 in the manner that the transfer sheet P is not on the seam 31*a*.

In this embodiment, the following is satisfied;

$$L=n(l+a)$$

where l is a length of the maximum usable transfer sheet P measured in the direction of the transfer drum 30 rotation, a is a sheet interval, and n is an integer.

By determining the circumferential length (L) of the transfer drum 30, the film sheet 31 can be efficiently used, and in the continuous mode, the number of image formations on the transfer sheet P per unit time is increased.

In the image forming apparatus of FIG. 4, it is desirable to determine the sheet intervals in accordance with the sizes of the transfer sheets so as to satisfy:

$$L=n(a+l)\ \text{(n: integer)}$$

for all of fixed sizes of the transfer sheet usable with the apparatus, where L is the circumferential length of the transfer belt (recording material carrying means), a is a sheet interval, and l is the length of the transfer sheet measured in the transfer belt movement direction.

Table 1 sheet shows intervals a for various usable sizes in the case of the circumferential length L of 1600 mm.

TABLE 1

| No. | Length | Interval |
|---|---|---|
| | A4 | |
| 1 | 210 | |
| | | >110 |
| 2 | 210 | |
| | | >110 |
| 3 | 210 | |
| | | >110 |
| 4 | 210 | |
| | | >110 |
| 5 | 210 | |
| | | >110 |
| 6 | 210 | |
| | B4 | |
| 1 | 364 | |
| | | >169 |
| 2 | 364 | |
| | | >169 |
| 3 | 364 | |
| | | >169 |
| 4 | 364 | |
| | A3 | |
| 1 | 420 | |
| | | >113 |
| 2 | 420 | |
| | | >113 |
| 3 | 420 | |
| | | >113 |
| 4 | 420 | |

Figure 7:
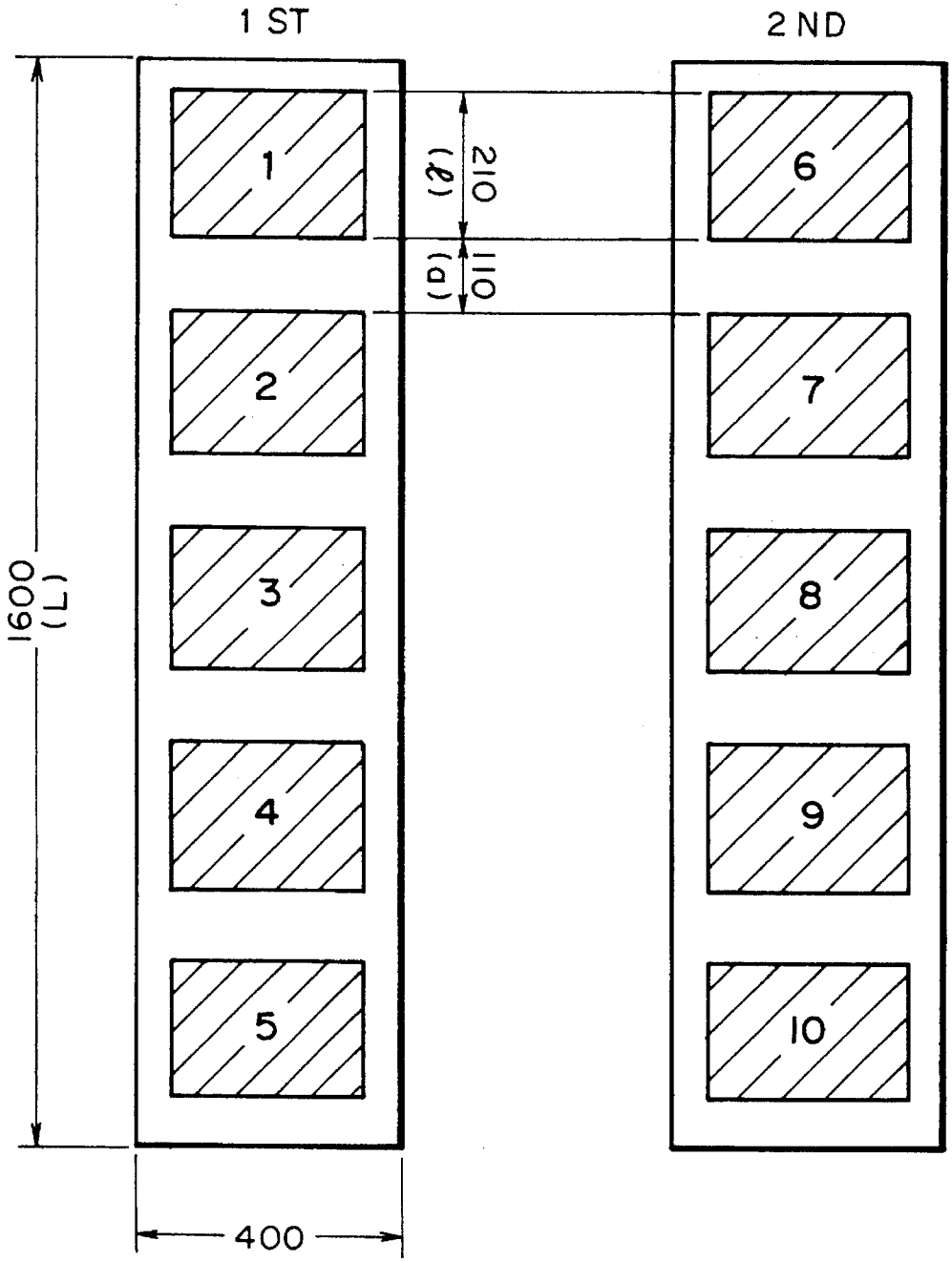
FIG. 7 is a top plan View illustrating the position of the transfer sheet attracted on the transfer belt.

FIG. 7 shows the positions of the transfer sheet P on the transfer belt 10 in this embodiment. In this Figure, the transfer belt 10 is expanded. The sheet interval a is 110 mm which is slightly long. However, in the continuous mode, the position of the transfer sheet attracted on the transfer belt 10 is the same, and therefore, the backside of the transfer material is not contaminated. The contamination at the back of the transfer sheet will be described. A second transfer sheet is not always supported on the transfer belt exactly at the same position as the first transfer sheet. It is possible that the second sheet is supported with deviation from the first sheet supported position with some overlapping. Because of the toner attraction in the sheet interval region, which will be described hereinafter, the second and subsequent transfer materials are contaminated at the back sides thereof.

The causes of the backside contamination are as follows:

(1) Deposition of suspending toner

In addition to the toner deposited to the photosensitive drum 1 (1*a* –1*d*) during the developing operation or the like from the developing device 4 (4*a* –4*d*). In addition, there is toner scattered from the developing device by the centrifugal force due to the developing sleeve rotation or the like. The cleaning device 6 (6*a* –6*d*) has the function of removing the residual toner from the photosensitive drum 1 and collect it however, the toner removed from the photosensitive drum is not completely collected in the container of the cleaning device, but a slight amount of the toner scatters. These toner particles fall on the transfer belt 10 and causes the backside contamination.

(2) Deposition of fog toner (i) In the case wherein the developing operation is carried out for the sheet interval region (non-image formation area), the developing action occurs in the non-image formation area because of the existence, in the developer, of the toner having smaller charge or having the opposite polarity charge.

Figure 8:
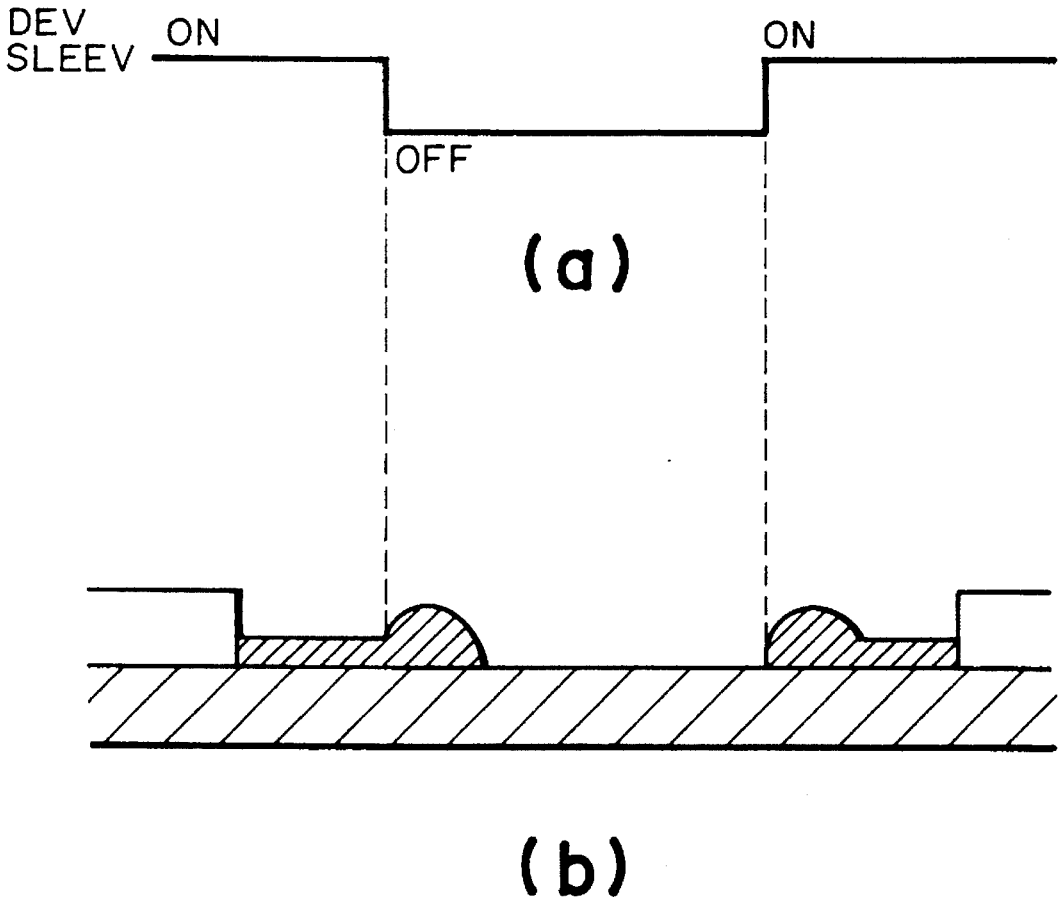
FIG. 8 illustrates backside contamination of the transfer material.

(ii) In the case wherein the developing operation is not carried out for the sheet interval, the sleeve rotation is stopped and resumed at the edge of the non-image formation area. The movement of the developing sleeve is as shown in FIG. 8A. The toner remaining on the photosensitive drum 1 at this time is as shown in FIG. 8B. Generally, the toner contamination due to the stoppage and resumption of the developing sleeve rotation is more significant than in the case of (i).

However, according to this embodiment of the present invention, the control is effected during the continuous image forming operation so that the transfer sheets are always supported on the transfer belt at the constant position, by properly setting the belt circumferential length and the sheet interval distance. Therefore, the backside of the transfer material is not contaminated.

The interval a is dependent on the size of the transfer sheet. However, in the continuous mode, the sheet interval a is always constant (110 mm for A4 size as shown in Table 1). The time intervals between adjacent transfer sheets are constant, and therefore, the operator is not threatened by the sheet discharge at different intervals. In addition, the sequential control for the apparatus may be simplified.

Figure 9:
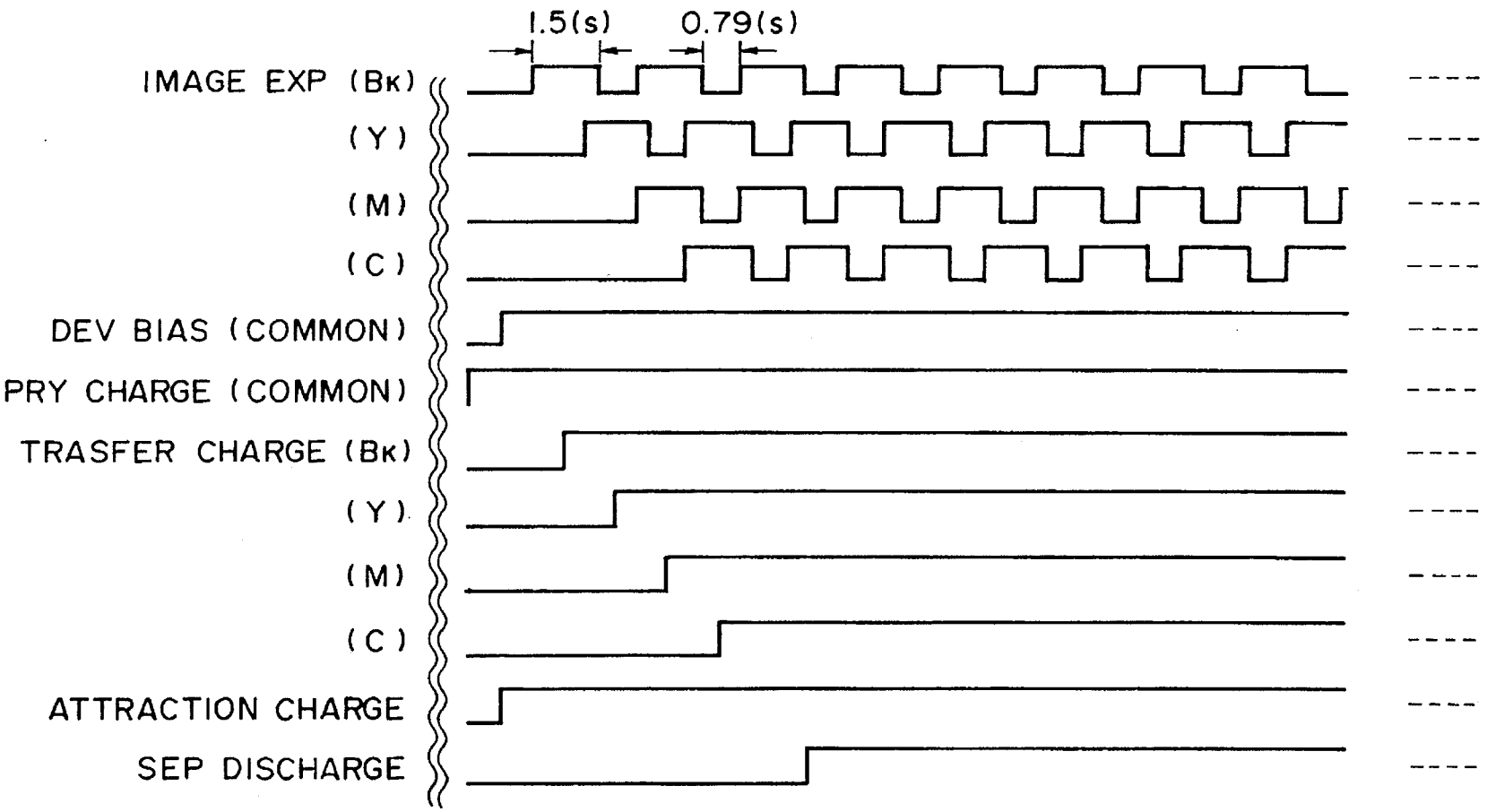
FIG. 9 shows sequential operations of the image forming apparatus.

FIG. 9 shows the sequential operations of the apparatus in the continuous mode when the size of the transfer sheet is A4.

Figure 10:
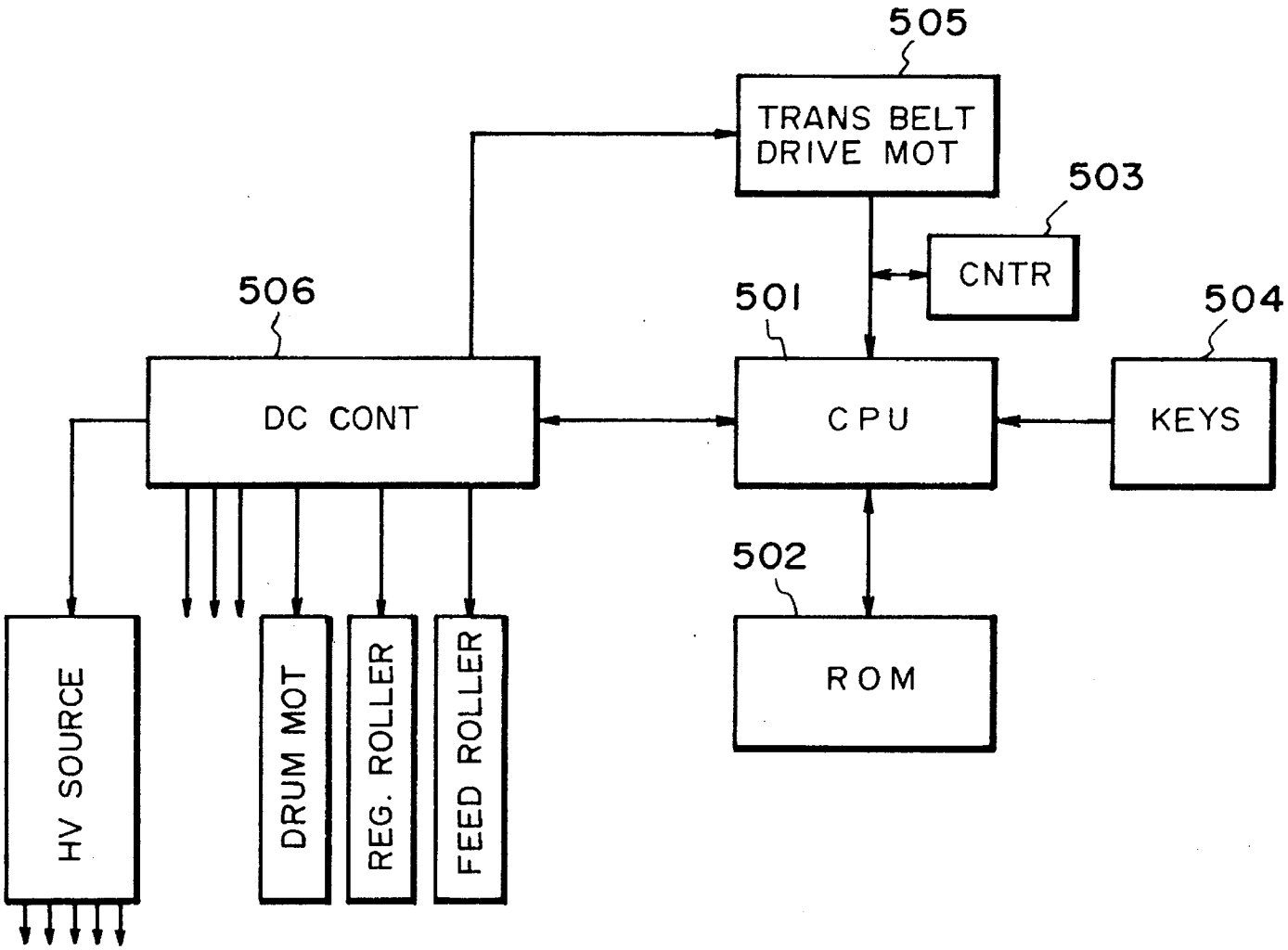
FIG. 10 is a first block diagram for the image forming apparatus.

FIG. 10 is a block diagram of the control system for the image forming apparatus of this embodiment. The sequential operations are controlled by CPU 501, and the sequential operations are instructed by ROM 502. Various elements in the main assembly, such as the sheet pick-up roller, registration rollers, photosensitive drum motor, a high voltage source for supplying electric power to the chargers, are controlled by the CPU 501 through a DC controller 506, D/A converter, I/O port.

The operational timing is determined by counting pulse clocks produced by the transfer belt driving motor (pulse motor) 505 by a counter 503, and by referring the counts to ROM 502 through the CPU 501.

The sheet interval distance corresponding to the size of the transfer material as defined in Table 1 is stored in a part of the ROM 502. In accordance with the size of the transfer material and the number of copies to be produced which are inputted by operation keys 504 by the operator, the control is effected in the continuous mode that the positions of the transfer materials attracted on the transfer belt are at all times constant on the transfer belt.

However, if the sequential operations are performed on the basis only of the pulse clock signals produced by the belt driving motor 505, there is a possibility of a problem particularly when the strict control accuracy is required or when a number of copies or prints which can be set by the operator by one input is large, because the number of the produced clockpulses involves approximately ±0.5 % at the maximum.

Therefore, according to this embodiment, a light blocking plate 30 is provided to detect the home position of the transfer belt 10 by the photosensor 506 at every rotations. On the basis of the detection, the pulse clock from the belt driving motor 505 is reset for every one rotation of the transfer belt.

Figure 11:
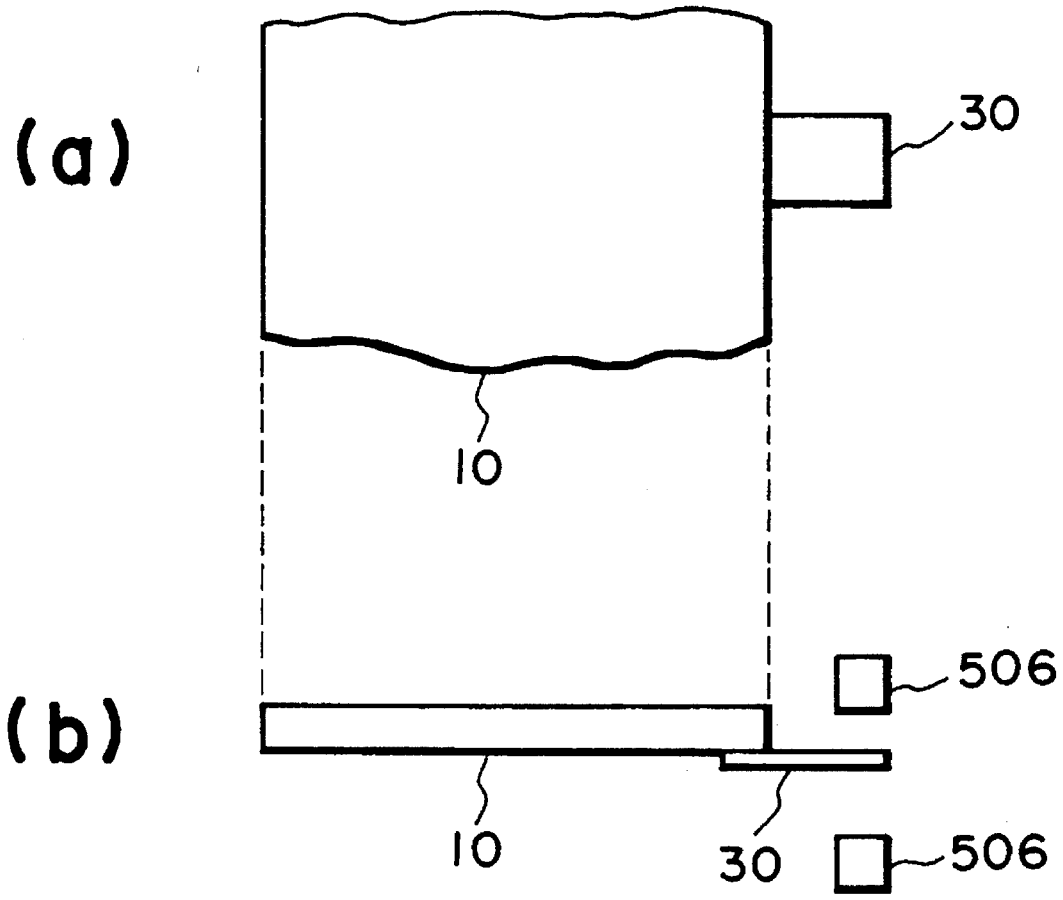
FIG. 11 illustrates a home position detecting system for the transfer belt.

FIGS. 11A and 11B show the detecting method. FIG. 11A is a top plan view of the transfer belt 10, and FIG. 11B is a partial sectional view thereof. In this embodiment, the detecting means is an optical type using a photosensor, but it is not limiting, and the electric, magnetic or the like type is usable.

Figure 12:
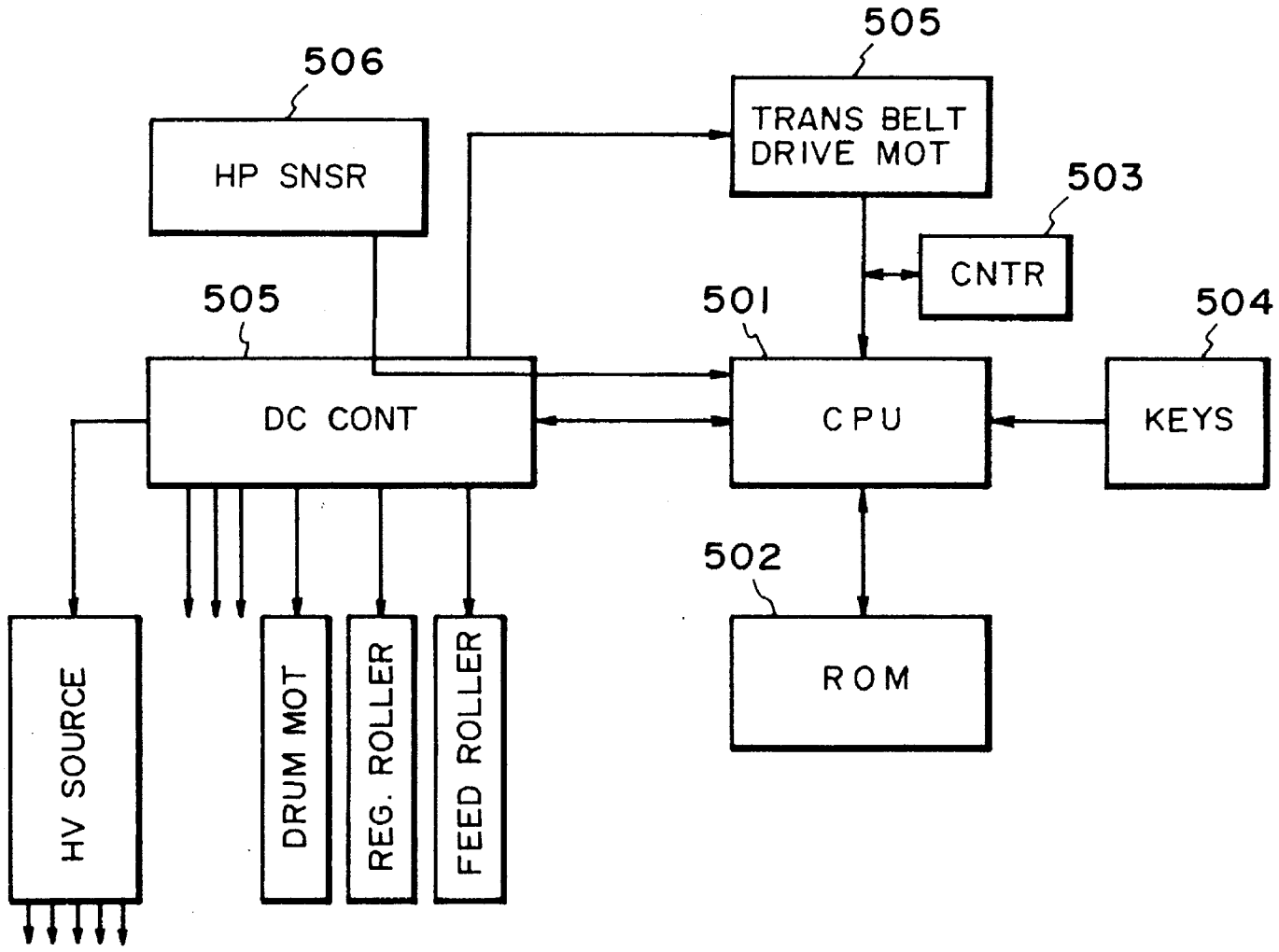
FIG. 12 is a second block diagram for the image forming apparatus.

FIG. 12 is a block diagram in this embodiment. The pulse clock supplied from the belt driving motor 505 is counted by the counter 503, and the count is supplied to the CPU 501. When a predetermined number of clockpulses X is counted, the one full-rotation of the transfer belt 10 is discriminated. In the case of the block diagram of FIG. 10, the start of the second period is discriminated. In the case of this embodiment shown in FIG. 12, the counter 503 is reset upon detection of the home position by the sensor 506 irrespective of whether the count reaches the predetermined value X or not. Then, the count becomes "zero", and the start of the second period is discriminated. Using the block diagram of FIG. 12, the further accurate operational sequence can be used as compared with FIG. 10 case.

In the foregoing embodiments, plural photosensitive drums are provided to form a full-color image on a recording material. The present invention is applicable to full-color or black- or white-image is formed with a single photosensitive drum.

The present invention is applicable to an ink jet type apparatus using image forming stations PA, PB, PC and PD having ink jet recording heads. The images are directly formed on the sheet carried on the belt 10.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a recording material carrying means for carrying a recording material, said recording material carrying means having a seam and being movable along an endless path;

image forming means, having a plurality of image forming positions, for sequentially forming a plurality of images on the recording material carried on said recording material carrying means;

supply means for supplying recording materials to said recording material carrying means;

control means for controlling supply timing of said supply means such that when a plurality of recording materials are continuously supplied to said recording material carrying means to form superimposed images by said image forming means on the plurality of the recording materials, irrespective of the number of said plurality of recording materials, the recording material supplied by said supply means is not overlapped on the seam, and the recording materials are supplied at substantially regular time intervals so as to satisfy $a=(L/n)-l$, where a is a distance between a trailing edge of said recording material and a leading edge of the next recording material, L is a circumferential length of said recording material carrying means, l is a length of said recording material measured in a direction of movement of said recording material carrying means, and n is a maximum number of at least 2 of the recording materials capable of being carried on said recording material carrying means during one full rotation of said recording material carrying means, wherein the number n is different depending on the length l.

2. An apparatus according to claim 1, wherein the distance a for a usable size of the recording material is twice the interval a for the recording material having one half size.

3. An apparatus according to claim 1 or 2, wherein said recording material carrying means is in the form of an endless belt.

4. An apparatus according to claim 1, wherein said image forming means includes plural image bearing members and transfer means for transferring an image from said image bearing members to the recording material, wherein plural images are superposedly formed on the same recording material.

5. An apparatus according to claim 4, wherein said image forming means includes plural image bearing members and transfer means, and plural images are formed on the same recording material.

6. An apparatus according to claim 4, wherein said apparatus is capable of forming a full-color image.

7. An apparatus according to claim 1, wherein the number n is one half the maximum number n when the length of the recording material is l/2.

8. An apparatus according to claim 1, 2 or 7, wherein the recording material is positioned a predetermined distance from the seem and the predetermined distance is smaller than the distance a.

* * * * *

UNITED STATES PATENT AND TRADEMARK OFFICE

CERTIFICATE OF CORRECTION

PATENT NO. : 5,557,383

DATED : September 17, 1996

INVENTOR(S) : TAKASHI HASEGAWA, ET AL.

It is certified that error appears in the above-indentified patent and that said Letters Patent is hereby corrected as shown below:

Figure 9,

"TRASFER" should read --TRANSFER--.

Column 2, line 23, "sheet 5" should read --sheets--; and line 36, "K=(210 x 3)800 x 100 = 78,725%" should read --K=(210 x 3)/800 x 100 = 78.725%--.

Figure 6A:
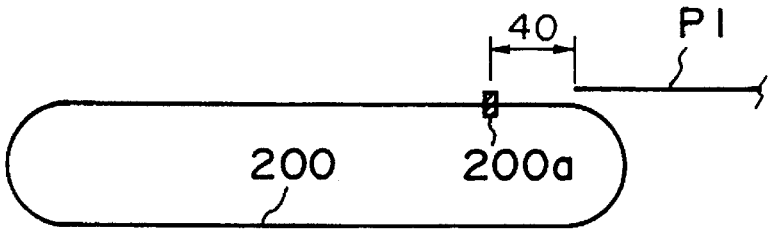
FIGS. 6B and 6C shows the supply of the transfer belt to the transfer material conveying belt in the image forming apparatus.
Figure 6B:
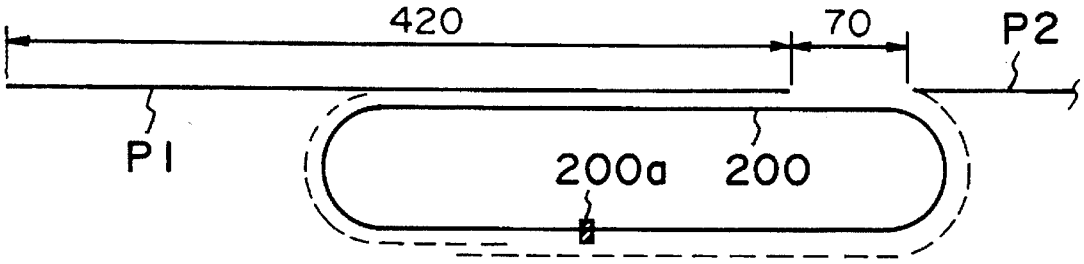
Figure 6C:
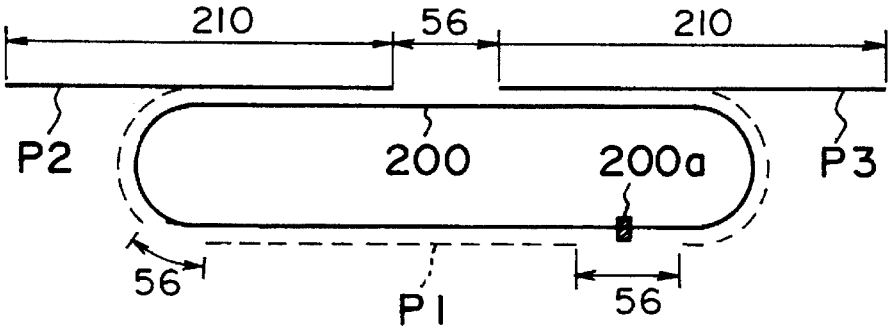

Column 3, line 6, "FIGS. 6B" should read --FIGS. 6A, 6B--, and "shows" should read --show--; and line 44, "5dis" should read --5d is--.

Column 5, line 19, "K=420 x 2/980 x 100m - 85.7%" should read --K=420 x 2/980 x 100 ≈ 85.7%--;

line 40, "K=210 x 3/980 x 100m - 64%" should read --K=210 x 3/980 x 100 ≈ 64%,--; and line 54, "K=210 x 3/980 x 100m - 77.8%" should read --K=210 x 4/1080 x 100 ≈ 77.8%--.

UNITED STATES PATENT AND TRADEMARK OFFICE

CERTIFICATE OF CORRECTION

PATENT NO. : 5,557,383
DATED : September 17, 1996
INVENTOR(S) : TAKASHI HASEGAWA, ET AL.

It is certified that error appears in the above-indentified patent and that said Letters Patent is hereby corrected as shown below:

Column 7,
line 1, "sheet shows" should read --shows sheet--.
Column 9,
line 40, "means;" should read --means; and--.
Column 10,
line 41, "seem" should read --seam--.

Signed and Sealed this

Eighteenth Day of March, 1997

Bruce Lehman

*Attest:*

BRUCE LEHMAN

*Attesting Officer*

*Commissioner of Patents and Trademarks*